United States Patent [19]

Dworak et al.

[11] 4,400,146

[45] Aug. 23, 1983

[54] FLUID-OPERATED GEAR MACHINE

[75] Inventors: Wilhelm Dworak, Stuttgart; Karl-Heinz Müller; Siegfried Mayer, both of Vaihingen; Wolfgang Talmon, Oetisheim; Kurt Grabow, Feucht, all of Fed. Rep. of Germany

[73] Assignee: Robert Bosch GmbH, Stuttgart, Fed. Rep. of Germany

[21] Appl. No.: 235,132

[22] Filed: Feb. 17, 1981

[30] Foreign Application Priority Data

Mar. 6, 1980 [DE] Fed. Rep. of Germany ... 8006057[U]

[51] Int. Cl.[3] ..... F04C 15/00; F01C 19/08

[52] U.S. Cl. ..... 418/131; 418/205; 418/206; 418/132

[58] Field of Search ..... 418/131, 132, 205, 206

[56] References Cited

FOREIGN PATENT DOCUMENTS 914616 1/1963 United Kingdom ..... 418/131

1008726 11/1965 United Kingdom ..... 418/131

*Primary Examiner*—Charles J. Myhre

*Assistant Examiner*—E. Rollins Cross

*Attorney, Agent, or Firm*—Michael J. Striker

[57] ABSTRACT

A gear machine, such as a gear pump or gear motor, has a housing in a chamber of which there are journalled two gears which mesh with one another. One of the gears is mounted on a drive shaft the end of which is extended outwardly from the housing. The housing is closed at one side thereof with a cover having a stepped bore for receiving the end portion of the drive shaft. The cover is formed with a circumferential projection concentric with the drive shaft and adapted for centering the cover relative to an external element to be coupled with the gear machine. The stepped bore provided in the cover forms a chamber in which a centering ring with a certain radial play is positioned, which centering ring surrounds the drive shaft. A sealing ring is also positioned in the chamber formed in the stepped bore, which sealing ring sealingly closes the housing. The centering ring provides for reliable aligning of the gear machine to the external element adapted to be coupled with the machine.

9 Claims, 5 Drawing Figures

FLUID-OPERATED GEAR MACHINE

BACKGROUND OF THE INVENTION

The present invention relates generally to a fluid-operated gear machine, and more particularly to a gear machine of the type which can be used as a pump or a hydraulic motor.

Fluid-operated machines are already known, capable of being used as a fluid pump or a fluid motor having a housing provided with a chamber in which two externally meshing gears are mounted, of which one gear is arranged on a drive shaft extending outwardly from the housing to be connected to any foreign element, for example an electric motor. Means for aligning the drive shaft of the fluid pump with the aforementioned foreign element such as a flange of the electric motor are usually required in the known machines. It is to be understood that the drive shaft is not rigidly mounted in the housing of the pump but is able to move a relatively small distance in a radial direction. Until now it has been necessary to use a special arrangement for aligning the drive shaft to the electric motor during assembly. This has been found rather complicated and expensive because of the utilization of special equipment.

SUMMARY OF THE INVENTION

It is an object of the present invention to further improve a fluid-operated machine of the type under discussion so as to overcome the disadvantages of the prior art.

More particularly, it is an object of the present invention to provide an improved fluid-operated machine of the type under discussion which can be produced more easily and at less expense than what is known from the prior art.

More particularly still, it is an object of this invention to provide an improved gear machine, such as a gear pump or gear motor, which is provided with a reliable aligning means used for coupling the gear machine to an external element to be coupled with the gear machine.

These and other objects are attained by a gear machine, such as a gear pump or hydraulic motor, comprising a housing, a drive shaft located in said housing and having an end outwardly extending from the housing, at least two meshing gears located in said housing, one of said gears being mounted on said drive shaft, bearing means journalling said shaft for rotation and mounted the same with slight radial play, a cover having a stepped bore to receive the shaft and sealingly closing the housing; and means for aligning said shaft with said bore in the cover, including a centering ring located in said stepped bore with a relatively small radial play and surrounding said drive shaft.

The stepped bore in the cover may be formed with a first portion of a relatively smaller diameter and with a second portion of a relatively larger diameter constituting a chamber in which the centering ring is positioned.

The first portion of the stepped bore may be separated from the second portion thereof by a shoulder, the centering ring being positioned in the vicinity of said shoulder.

The machine may be further provided with a sealing ring located in the chamber of the cover and surrounding the drive shaft, said centering ring being positioned between the shoulder and said sealing ring.

Centering means on the cover may be formed by a circumferential projection on the cover, said projection extending toward the end of the drive shaft and having a predetermined diameter.

The centering ring located in the aforementioned chamber has an inner surface surrounding the drive shaft and an outer surface. The centering ring may be formed with a plurality of recesses radially outwardly extended from the inner surface of the ring, which recesses are circumferentially spaced from one another.

The centering ring may include a plurality of elastically yielding projections circumferentially positioned on the inner surface and the outer surface of the ring.

The centering ring may be also formed with a radially extending slot or be coated with layers of an elastic material located on the inner surface and the outer surface of the ring; respectively.

The novel features which are considered characteristic for the present invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
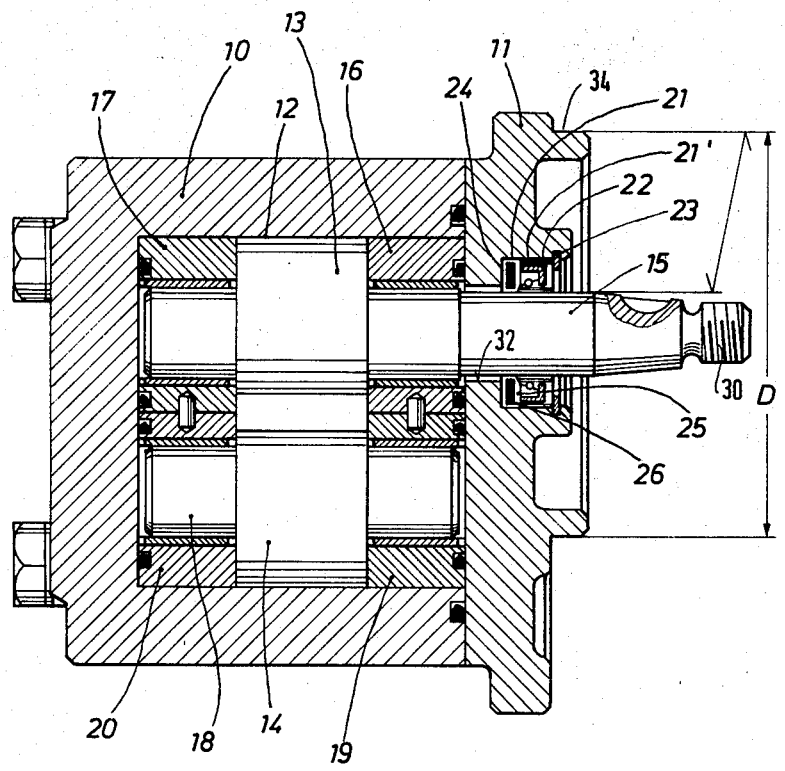
FIG. 1 is an axial section through a fluid-operated machine according to the present invention.

Referring first to FIG. 1, it will be noted that the fluid-operated machine illustrated herein, which may be operated as a pump or as a fluid motor, has a housing 10 closed by a cover 11. The gear pump housing is formed with an internal chamber 12 in which a pair of meshing gears 13 and 14 is mounted. The teeth of these gears mesh with one another so that the gears can perform a pumping function or act as a motor, in accordance with the operation of such gear machines which is well known in the art. The gears are mounted on stub shafts 15 and 18, respectively, of which the shaft 15 is a drive shaft having an end portion 30 outwardly projecting from the housing 10. The shafts 15 and 18 are journalled in journalling sleeves 16,17 and 19,20, respectively. These sleeves are arranged in the chamber 12 of the housing 10 in such a manner that the sleeves 16 and 17 receive the drive shaft 15 and the sleeves 19 and 20 receive the stub shaft 18. The bearing sleeves are mounted in the chamber 12 of the housing so that they may move at least a relatively small distance in a radial direction. This is necessary for the normal running of the gears.

The cover 11 is formed with a stepped bore 21 through which the drive shaft 15 passes in an outward direction. The stepped bore 21 is formed with a shoulder 24 so that this bore includes a first portion 32 of relatively smaller diameter which surrounds the shaft 15 and a second portion of relatively larger diameter constituting a chamber or recess 21'. A sealing ring 22, which is preferably a retaining ring, is positioned in the recess 21' which extends outwardly toward the end of the drive shaft 15. The sealing ring 22 is retained in its position within the chamber 21' by means of a circlip 23 which prevents the sealing ring from falling out of the recess 21'. The sealing ring 22 is so positioned in the portion of the stepped bore of a relatively larger diameter that a relatively small chamber 25 is formed between the sealing ring 22 and the shoulder 24. A centering ring 26 is situated within the chamber 25 so that this ring surrounds the shaft 15 by its inner surface and its outer surface is positioned within the recess 21' with a relatively small radial play.

As is clearly seen in FIG. 1, the cover 11 is provided with a circumferential projection 34 which is extended outwardly from the housing 10 towards the end of the drive shaft 15. This circumferential projection has a predetermined diameter "D" and serves for centering the cover to an external element to be coupled with the gear machine of the foregoing type, for example to a flange of an electric motor.

As was mentioned above, the centering ring 26 is positioned within the chamber 21' with a relatively small radial play. This play provides for the reliable aligning of the drive shaft 15 relative to the projection 34 which is concentric to the shaft 15, whereby the gear machine may be easily aligned with an external element. By provision of the centering ring in the construction of the gear machine the necessity of the utilization of special centering equipment may be avoided.

It is to be noted that in operation of the gear machine of the foregoing type, the displacement of the centering ring relative to the drive shaft may cause a certain wear of the parts to be involved. However, this wear is not critical if a suitable material for the parts of the machine is chosen.

Figure 2:
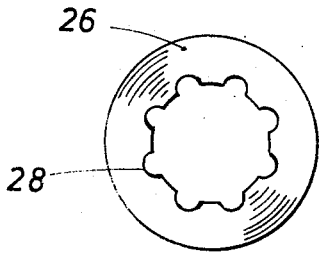
FIG. 2 shows a centering ring in accordance with a first embodiment of the invention.

In order to reduce the wear of the working elements in the gear machine, it is suggested to provide the centering ring with a certain elastic property. For this purpose the centering ring 26 may be formed with a plurality of recesses radially outwardly extended from the inner surface of the centering ring. The recesses 28 clearly illustrated in FIG. 2 are circumferentially spaced from one another and are located not too close to each other so as to maintain a substantial bearing surface of the centering ring surrounding the drive shaft 15.

Figure 3:
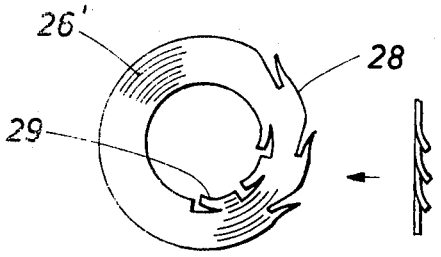
FIG. 3 shows a second embodiment of the centering ring according to the invention.

In order to compensate the difference between the outer diameter of the drive shaft 15 and the diameter of the recess 21' it is advantageous to provide the centering ring 26' as clearly shown in FIG. 3 with a number of elastically yieldable projections 28 and 29. As clearly seen in FIG. 3 the projections 28 are formed on the outer surface of the centering ring 26', whereas the projections 29 are provided on the inner surface of the centering ring.

Figure 4:
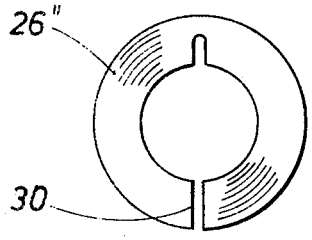
FIG. 4 shows a further embodiment of the centering ring according to the invention.

In the embodiment shown in FIG. 4, the centering ring 26'' is formed with a radial slot 30 having two diametrically opposed portions, one of which extends through the entire width of the centering ring 26'' and the other one of which extends only partially into the width of the ring.

Figure 5:
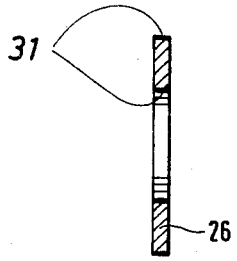
FIG. 5 is a sectional view of the centering ring of a further embodiment of the invention.

FIG. 5 illustrates a further embodiment of the centering ring 26 which is provided with a layer of a coating material 31 covering the inner surface of the centering ring 26 as well as the outer surface thereof. The coating layer 31 made preferably of an elastic material serves for reducing of the radial play. It is effective to produce the centering ring 26 as a stamped element.

It will be understood that each of the elements described above, or two or more together, may also find a useful application in other types of gear machines differing from the types described above.

While the invention has been illustrated and described as embodied in gear machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a gear machine, such as a gear pump or hydraulic motor, a combination comprising a housing; a drive shaft located in said housing and having an end outwardly extended from said housing; at least two meshing gears located in said housing, one of said gears being mounted on said drive shaft; bearing means journalling said shaft for rotation and mounting the same with slight radial play; a cover having a stepped bore to receive said shaft and sealingly closing said housing; and means for aligning said shaft with said bore in a radial direction, including a centering ring located in said stepped bore with a relatively small radial play and surrounding said drive shaft.

2. The machine of claim 1, wherein said stepped bore is formed with a first portion of a smaller diameter and a second portion of a larger diameter constituting a chamber, said centering ring being positioned in said chamber.

3. The machine of claim 2, wherein said first portion is separated from said second portion by a shoulder, said centering ring being positioned in the vicinity of said shoulder.

4. The machine of claim 3, including a sealing ring located in said chamber and surrounding said drive shaft, said centering ring being positioned between said shoulder and said sealing ring.

5. The machine of claim 4, and further comprising centering means on said cover end formed by a circumferential projection thereon, said projection extending toward said end of said drive shaft and having a predetermined diameter.

6. The machine of claim 5, wherein said centering ring has an inner surface surrounding said drive shaft and formed with a plurality of recesses radially outwardly extended from said surface, said recesses being circumferentially spaced from one another.

7. The machine of claim 5, wherein said centering ring has an inner surface surrounding said drive shaft and an outer surface, said centering ring including a plurality of elastically yieldable projections circumferentially positioned on said inner surface and said outer surface, respectively.

8. The machine of claim 5, wherein said center ring is formed with a radially extending slot.

9. The machine of claim 5, wherein said centering ring has an inner surface surrounding said drive shaft and an outer surface, said inner and outer surfaces being each coated with a layer of an elastic material.

* * * * *